United States Patent [19]

Fey

[11] Patent Number: 4,543,514

[45] Date of Patent: Sep. 24, 1985

[54] CENTRAL LOCKING SYSTEM FOR MOTOR VEHICLES

[75] Inventor: Rainer Fey, Schweinfurt, Fed. Rep. of Germany

[73] Assignee: Fichtel & Sachs AG, Schweinfurt, Fed. Rep. of Germany

[21] Appl. No.: 614,448

[22] Filed: May 25, 1984

[30] Foreign Application Priority Data

Jun. 1, 1983 [DE] Fed. Rep. of Germany ..... 3319830

[51] Int. Cl.[4] ..... F05B 47/00

[52] U.S. Cl. ..... 318/282; 318/484; 307/10 AT; 180/289

[58] Field of Search ..... 318/282, 484, 452; 307/10 AT; 180/286, 289; 20/239

[56] References Cited

U.S. PATENT DOCUMENTS

| | | | |
|---|---|---|---|
| 4,425,597 | 1/1984 | Schramm | 307/10 AT |
| 4,427,929 | 1/1984 | Alexandru et al. | 318/282 |
| 4,428,024 | 1/1984 | Mochida et al. | 180/289 X |
| 4,450,390 | 5/1984 | Alexandru et al. | 318/468 X |
| 4,488,056 | 12/1984 | Mochida | 180/289 X |

FOREIGN PATENT DOCUMENTS 3008964 9/1981 Fed. Rep. of Germany .

*Primary Examiner*—B. Dobeck

*Attorney, Agent, or Firm*—Toren, McGeady, Stanger, Goldberg & Kiel

[57] ABSTRACT

The central locking system for motor vehicles comprises a plurality of catch drives reversibly driving between a locking position and an unlocking position. The catch drives are switched on for a pre-determined time duration in the locking direction by drive signals of a first time control circuit. The catch drives are energized in the unlocking direction by a second time control circuit for a pre-determined time duration. The time control circuits can be triggered alternately through a triggering control switch actuatable by means of a door key from outside the vehicle, or by means of a press-button switch actuatable from within the motor vehicle. The trigger inputs of the time control circuits are connected through separate trigger paths to the press-button switch.

12 Claims, 2 Drawing Figures

CENTRAL LOCKING SYSTEM FOR MOTOR VEHICLES

BACKGROUND OF THE INVENTION

The invention relates to a central locking system or installation for motor vehicles the ignition and/or starter of which can be switched on and off through a control switch operable by means of a key, having a plurality of catch drives driving reversibly between a locking position and an unlocking position, a first time control circuit which on triggering supplies first drive signals for a predetermined time duration to the catch drives for driving the catch drives in the direction towards the locking position, a second time control circuit which on triggering supplies second drive signals for a predetermined time duration to the catch drives for driving the catch drives in the direction towards the unlocking position, and at least one triggering control switch operable by means of a key from outside the vehicle, which in a first switch position triggers the first time control circuit and in a second switch position triggers the second time control circuit.

STATEMENT OF PRIOR ART

Such a central locking installation is known from DE-A No. 3,008,964. The catch drives drive locking devices on the door locks. The time control circuits can be triggered from outside the vehicle by means of the door keys through the triggering control switches provided on the doors. From the interior of the motor vehicle the catch drives can be mechanically locked and unlocked by means of "locking buttons" on the doors.

OBJECT OF THE INVENTION

The invention provides a central locking installation which can be operated not only by means of the door key from outside the motor vehicle, but also through a press-button switch from the interior of the vehicle. In this case it is to be made certain that when the control switch is switched off (ignition switched off) the central locking installation cannot be unlocked by unauthorised actuation of the press-button switch.

SUMMARY OF THE INVENTION

The central locking installation according to the invention is based on an installation as it is known from DE-A No. 3,008,964 and is explained above. Additionally the first and the second time control circuits are connected through separate trigger paths to at least one common press-button switch operable from within the motor vehicle. The trigger path connecting the press-button control switch with the first time control circuit is triggerable independently of the switch position of the control switch and comprises a first gate circuit responding to the drive position of the catch drives. The gate circuit blocks the trigger path when the catch drives are in the locking position, and enables the first time control circuit to be triggered by the press-button control switch when the catch drives are in the unlocking position. The trigger path connecting the press-button control switch with the second time control circuit comprises a second gate circuit controllable through the control switch which blocks the trigger path when the control switch is switched off and enables the second control circuit to be triggered by the press-button control switch when the control switch is switched on. A blocking circuit responding to the drive signals of the first time control circuit blocks the drive signals of the second time control circuit during the occurrence of the drive signals of the first time control circuit.

The two time control circuits are triggerable not only through the door triggering control switches which are actuatable by means of the door keys, but also by way of the two trigger paths connected to the common press-button control switch. The gate circuits in the two trigger paths ensure that the central locking installation can be locked but not unlocked by actuation of the press-button control switch when the control switch is opened and thus the ignition is switched off. Thus unauthorised unlocking of the doors by means of the press-button control switch is not possible. When the control switch is switched on, that is the ignition is switched on, the central locking installation can be either unlocked or locked by means of the press-button control switch.

In a preferred embodiment, to each catch drive there is allocated a switch contact detecting the drive position of the catch drive. The first gate circuit comprises a transistor switch connected into the trigger path and a control signal generator controlling the transistor switch and responding to the switch contacts. The switch contacts are preferably simple on-and-off switches. Since a transistor switch is used as gate circuit, unintentional triggering of the time control circuit by any spurious pulses and the like occurring in the electrical system of the motor vehicle can reliably be prevented.

A substantial improvement consists in that the control signal generator comprises a control voltage source responding to the switch contacts which generates a first control voltage when at least one of the switch contacts detects the locking position of the catch drive allocated to it and a second control voltage when all the switch contacts detect the unlocking position of the associated catch drives. The control signal generator further comprises a reference voltage source, the reference voltage of which lies between the first and the second control voltages, and a comparator which compares the reference voltage with the control voltage and controls the transistor switch accordingly. The switch contacts, connected with one another for example to form an OR contact network, open the transistor switch through the comparator when the catch drives are in the locking position and thus interrupt the trigger path of the first time control circuit. The supply of voltage to the reference voltage source, the control signal generator and the comparator and to the transistor switch takes place in shunt to the control switch. Thus it is ensured that when the control switch is switched on the next actuation of the common press-button control switch triggers the second time control circuit and thus the catch drives are switched on in the unlocking direction.

In embodiments in which the switch contacts responding to the drive position of the catch drives remain in their position blocking the trigger path of the first time control circuit only in the close vicinity of the locking position, it must be ensured that this trigger path remains blocked while the second time control circuit is triggered by means of the common press-button control switch. For this purpose it can be provided that the control voltage source is coupled to the press-button control switch and for the duration of the actuation of the press-button control switch supplies a third control voltage, occurring together with the first control voltage on the same side relative to the reference voltage, to the comparator for comparison with the reference voltage. The control voltage source can have the form of a potentiometer circuit (resistance divider circuit) which is connected to the battery of the motor vehicle and the divider ratio of whichis variable by means of the switch contacts and/or the press-button control switch. The essential advantage of the embodiment as explained above is its great security against spurious voltages, which results not least by reason of the use of a comparator or saturatable amplifier as control element for the transistor switch.

In conformity with the transistor switch of the first gate circuit, the second gate circuit can also be assembled using a transistor switch. The transistor switch of the second gate circuit is controlled by means of the control switch of the motor vehicle and enables the trigger path of the second time control circuit only when the control switched is switched on, that is the ignition is switched on. When the control switch is switched off the central locking installation can be unlocked only through the triggering control switch operable by means of the door key.

When the control switch is switched on and the catch drives are situated in the unlocking position both time control circuits are triggered on actuation of the common press-button control switch. The blocking circuit connected on the output side of the time control circuits ensures that in this case only the drive signals of the first time control circuit, which locks the catch drives, become effective. The distribution of the logic functions to the trigger side and the output side of the time control stages increases the security of the central locking installation against spurious voltages, with comparatively low constructional expense.

In a preferred embodiment of the invention an indicator lamp is provided which is controlled through a transistor switch by the switch contacts of the catch drives. The indicator lamp lights up when the central locking installation has been locked by actuation of the press-button control switch with the main control switch switched on.

The various features of novelty which characterise the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE PREFERRED EMBODIMENTS

Figure 1:
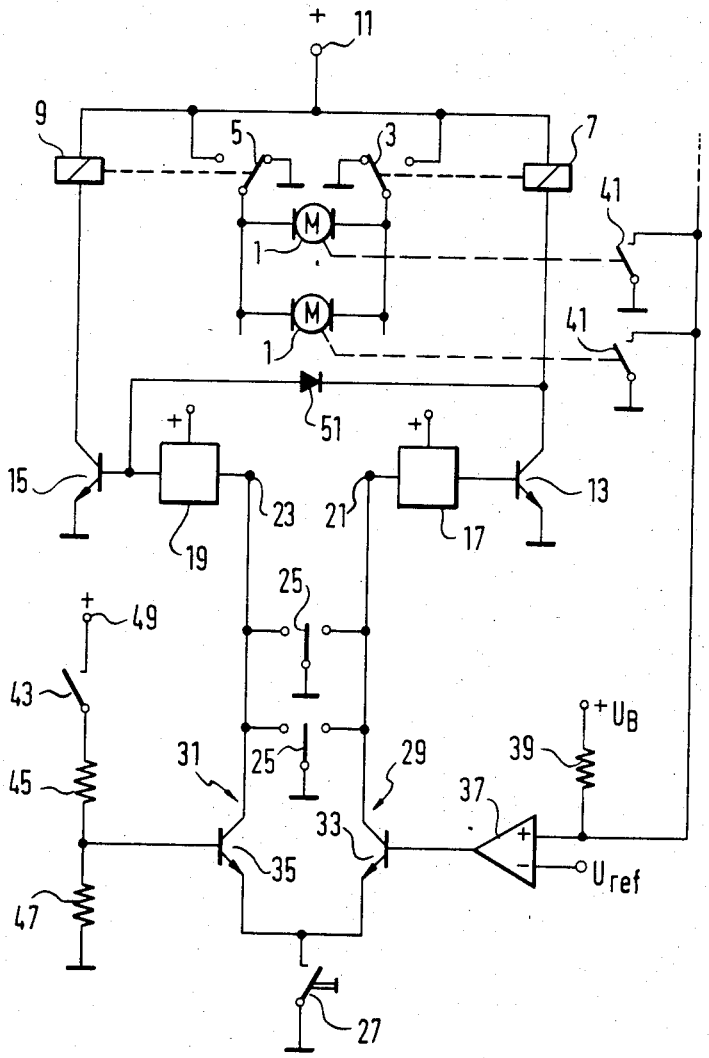
FIG. 1 shows a block circuit diagram of a central locking installation according to the invention.

The central locking installation according to FIG. 1 comprises direct-current motors 1 connected in parallel with one another to switch-over contacts 3 and 5 of two relays 7 and 9, for the drive of locking devices on door locks or the like. In the rest condition with relays 7, 9 unenergised the switch-over contacts 3 and 5 connect the motors 1 to earth. When the relays 7, 9 are in the energised condition the switch-over contacts 3 and 5 connect the motors 1 with an operating voltage source, for example the positive pole of a motor vehicle battery 11, the minus pole of which is earthed. The relays 7, 9 are energised in alternation and form a pole-changer circuit through which the motors 1 can be switched on in both directions of rotation. In the embodiment as illustrated the relay 7 switches on the motors 1 in the locking direction, in which the catch drive is moved out of an unlocking position into a locking position. The relay 9 switches on the motors 1 in the unlocking direction in which the catch drives are moved out of the locking position into the unlocking position.

The energisation of the relays 7, 9 is controlled by transistors 13 and 15 working in switch operation, the collector-emitter junction of which is connected in series with the energising windings of the relays 7, 9 between earth and the working voltage terminal 11. The transistors 13, 15 are controlled by separate time control circuits 17 and 19 to the trigger inputs 21 and 23 of which the fixed contacts of several mutually parallel-connected control change-over switches 25 are connected. The control change-over switches 25 are provided on the doors of the motor vehicle and can be switched over by means of the door key from their neutral middle position as represented in FIG. 1 into one of their two switch positions. In the right-hand switch position of the control change-over switches 25 in FIG. 1 the trigger input 21 of the time control circuit 17 is earthed and the time control circuit 17 is triggered. Thereupon the time control circuit 17 generates a current pulse of predetermined duration which allows the transistor 13 to become conductive and thus energises the relay 7 for the predetermined time duration. The relay 7 switches on the motors 1 in the locking direction for the predetermined time duration. If the control change-over switches 25 are switched into the switch position to the left in FIG. 1, the trigger input 23 is connected to earth and the time control circuit 19 is triggered. The triggered time control circuit 19 generates a current pulse of predetermined duration which allows the transistor 15 to become conductive and energises the relay 9 for the predetermined duration. The relay 9 switches on the motors 1 in the unlocking direction for the predetermined duration. The control change-over switches 25 are not mechanically coupled with the mechanical locking mechanisms of the door locks, which are actuated by the catch drives, and return into their neutral middle position on withdrawal of the door key.

To make it possible for the central locking installation to be also locked and unlocked from the interior of the vehicle, a press-button switch 27, open in its rest position, is provided which is connected on one side with earth and on the other through separate trigger paths 29 and 31 with the trigger inputs 21, 23 of the time control circuits 17, 19. Each of the two trigger paths 29, 31 contains a transistor 33 and 35 respectively working in switch operation, which in the conductive condition connects the press-button switch 27 with the trigger input 21 or 23 and in the blocking condition prevents the triggering of the time control circuits 17, 19 by means of the press-button switch 27.

The transistor 33 is controlled by a comparator 37 at the inverting input "−" of which a reference voltage $U_{ref}$ of a reference voltage source (not shown further) is present. The inverting input "+" of the comparator 37 is connected to a controllable voltage source, for example in the form of a resistor 39 connectable to a positive operating voltage source. Switch contacts 41, formed as simple on-and-off switches, on the catch drives detect the drive position of the associated catch drives. The switch contacts 41 are connected in parallel with one another in the form of an OR switch network. In the unlocking position of the catch drives they are opened and in the locking position they are closed. In the unlocking position, in which all switch contacts 41 are opened, the non-inverting input "+" of the comparator 37 lies through the resistor 39 at the potential $U_B$ of the operating voltage source, which is greater than the reference voltage $U_{ref}$ at the inverting input "−". The comparator 37 in this case generates an output signal which makes the transistor 33 conductive and clears the trigger path 29 for the triggering of the time control circuit 17, which switches on the motors 1 in the locking direction, by means of the press-button switch 27.

When the catch drives are in the locking position the switch contacts 41 are closed. The non-inverting input "+" of the comparator 37 lies at earth potential, so that the output signal of the comparator 37 blocks the transistor 33 and interrupts the trigger path 29. The time control circuit 17 cannot be triggered afresh by subsequent renewed actuation of the press-button switch 27.

The trigger path 31 of the time control circuit 19 which switches on the motors 1 in the unlocking direction is controlled in dependence upon a control switch or ignition switch 43 of the motor vehicle. By means of the ignition switch 43 the ignition system and/or the starter of the motor vehicle can be switched on and off in a manner not further illustrated. The ignition switch 43 is connected in series with a voltage-divider circuit or potentiometer circuit consisting of two resistors 45, 47 between a positive operating voltage source 49 and earth. The resistors 45, 47 are so dimensioned that the transistor 35 is blocked when the ignition switch 43 is opened and conductive when it is closed.

When the ignition switch 43 is opened and thus the ignition system is switched off, only the time control circuit 17 which switches on the motors 1 of the catch drives in the locking direction can be triggered by means of the press-button switch 27. The trigger path 31 of the time control circuit 19 which switches on the motors 1 in the unlocking direction is blocked when the ignition system is switched off. In the locked condition with the ignition system switched off the central locking installation cannot be released by unauthorized persons by actuation of the press-button switch 27.

With the ignition switch 43 closed the central locking installation can be alternately unlocked and locked by repeated actuation of the press-button switch 27. In the locked condition the switch contacts 41 are closed and the trigger path 29 accordingly is blocked. On actuation of the press-button switch 27, therefore, the time control circuit 19 exclusively is triggered and the motors 1 are switched on in the unlocking direction. In the unlocked condition the switch contacts 41 are opened, so that both trigger paths 29 and 31 connect the press-button switch 27 with the trigger inputs 21 and 23 of the time control circuits 17, 19. On actuation of the press-button switch 27 thus both time control circuits 17, 19 are triggered. In order to ensure that nevertheless only the relay 7 which switches on the motors 1 in the locking direction is energised, the collector of the transistor 13 is connected through a diode 51 with the base of the transistor 15. When the transistor 13 is conductive, the diode 51 forms a short-circuit for the base-emitter junction of the transistor 15 and blocks the transistor 15.

Figure 2:
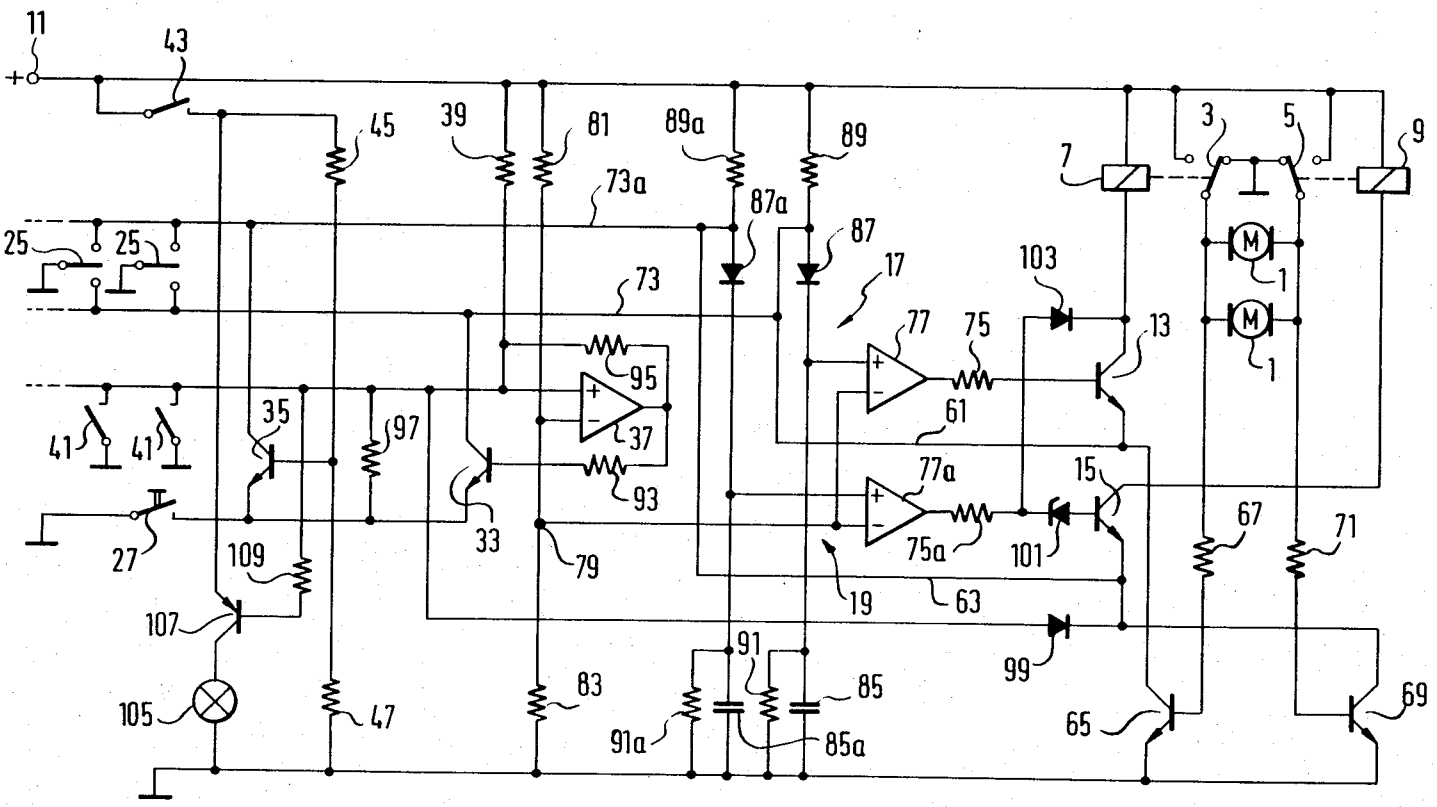
FIG. 2 shows a detailed circuit diagram of the central locking installation.

FIG. 2 shows a detailed circuit diagram of the central locking installation according to FIG. 1. Elements of like effect are designated by the same reference numerals in both Figures. For the explanation of these elements reference is made to FIG. 1.

The motors 1 of the catch drives are again connected to a pole-changer circuit formed by the switch-over contacts 3, 5 of the relays 7 and 9, which circuit connects the motors 1, in dependence upon the alternate energisation of the relays 7 and 9 for the two directions of rotation of the motors 1, with the working voltage source of battery 11 of the motor vehicle. The energising current of the relays 7, 9 is again controlled by transistors 13, 15 working in switch operation, the collector-emitter junctions of which are connected in series with the energiser windings of the relays 7 and 9. In contrast to the embodiment in FIG. 1 the emitters of the transistors 13, 15 are not connected directly to earth, but through leads 61, 63 with the parallel-connected fixed contacts of the control change-over switches 25 actuatable by means of the door keys. The movable contacts of the control change-over switches 25 are connected to earth and trigger the time control circuits 17 and 19, which are explained in greater detail below. As long as the control change-over switches 25 are deflected out of their neutral middle position for the triggering of the time control circuits 17, 19, they connect the emitters of the transistors 13, 15 to earth. Since the duration of actuation can be relatively short, holding circuits which keep the energising current of the relays 7, 9 switched on beyond the duration of actuation of the control change-over switches 25 are allocated to the energising circuits of the relays 7, 9. The holding circuit of the relay 7 includes a transistor 65 the collector-emitter junction of which is connected between the emitter of the transistor 13 and earth and thus is connected in parallel with the associated contacts of the control change-over switches 25. The base of the transistor 65 is connected through a base-current-limiting resistor 67 to the switch-over contacts 3 of the relay 7 to be controlled by the transistor 13. When the relay 7 is not energised the switch-over contact 3 connects the base of the transistor 65 to earth and blocks the transistor 65. If one of the control change-over switches 25 is switched over into its position triggering the time control circuit 17, the transistor 13 becomes conductive and the relay 7 is energised. The base of the transistor 65 is connected through the switch-over contact 3 with the working voltage terminal 11 and the transistor 65 becomes conductive. The energising current of the relay 7 thus flows, independently of the actuation of the control change-over switch 25, through the collector-emitter junctions of the conductive transistors 13 and 65. After the elapse of the time period determined by the time control circuit 17 the transistor 13 opens and switches off the energising current of the relay 7. The holding circuit of the relay 9 is assembled accordingly and comprises a transistor 69 working in switch operation, the collector-emitter junction of which is connected between the emitter of the transistor 15 and earth and thus in parallel to the contacts of the control change-over switches 25 which are allocated to the time control circuit 19. The base of the transistor 69 is connected through a base-current-limiting resistor 71 with the change-over contact 5 of the relay 9. The manner of operation of the holding circuit allocated to the relay 9 corresponds to the manner of operation of the holding circuit of the relay 7. The time control circuit 17 is triggered in that one of the control change-over switches 25 connects a lead 73, corresponding to the trigger input 21 in FIG. 1, to earth. The time control circuit 17 thereupon supplies a current pulse of predetermined duration to the base of the transistor 13 which allows the transistor 13 to become conductive for the predetermined duration. The base of the transistor 13 is connected for this purpose through a base series resistor 75 to the output of a differential amplifier working in saturation operation or a comparator 77. The inverting input "−" of the comparator 77 is connected to a junction point 79 of two resistors 81 and 83 connected in the form of a voltage-divider circuit or potentiometer circuit in series between earth and the working voltage terminal 11. The voltage-divider circuit forms a reference voltage source which applies a reference voltage of about $\frac{1}{3}$ of the working voltage to the inverting input "−" of the comparator 77. The non-inverting input "+" of the comparator 77 is connected to earth through a capacitor 85. The terminal of the capacitor 85 connected with the non-inverting input "+" of the comparator 77 is connected with the working voltage terminal 11 through a diode 87 polarised in the forward direction and a resistor 89 connected in series with the diode 87 on the side of the diode 87 remote from the capacitor. The junction point between the diode 87 and the resistor 89 is connected by the lead 73 with the fixed contacts of the control change-over switches 25 and through the lead 61 with the emitter of the transistor 13. The resistor 89 and the diode 87 form a charging circuit for the capacitor 85 through which the latter is charged up, with the control change-over switches 25 in the neutral middle position, to the potential of the working voltage terminal. A discharge resistor 91 is connected in parallel with the capacitor 85. With the control change-over switches 25 switched over into the trigger position of the time control circuit 17, the charging circuit is uncoupled from the capacitor 85 and the capacitor 85 discharges with the discharge time constant fixed by the resistor 91.

The time control circuit 17 works as follows. In the state of rest the control change-over switches 25 are situated in their neutral middle position, so that the capacitor 85 can charge up to the working voltage through the resistor 89 and the diode 87. The reference voltage on the connection point 79 amounts to about $\frac{1}{3}$ of the working voltage, so that the output voltage of the comparator 77 likewise nearly reaches the working voltage. However, the transistor 13 cannot become conductive since its emitter, through the resistor 89, likewise lies at working voltage potential. The relay 7 is not energised. On triggering of the time control circuit 17 one of the control change-over switches 25 connects the emitter of the transistor 13 through the leads 61, 73 to earth. The transistor 13 becomes conductive since at this moment as before its base lies at working voltage potential and the relay 7 is energised. With the closure of the control switch 25 at the same time the junction point of the resistor 89 and the diode 87 is connected to earth, whereby the charging current of the capacitor 85 is interrupted. Subsequently the capacitor 85 discharges through the resistor 91. A direct discharge of the capacitor 85 through the control change-over switch 25 is prevented by the diode 87 polarised in the blocking direction in relation to the charge of the capacitor 85. As soon as the voltage on the capacitor 85 has reached the reference voltage, the output level of the comparator 77 changes abruptly, whereby the base of the transistor 13 is switched to earth potential. The transistor 13 opens and interrupts the energising current of the relay 7.

The resistor 81 of the reference voltage source and the resistor 89 of the charging circuit of the capacitor 85 are connected to one common junction point. The charge voltage of the capacitor 85 and the reference voltage thus vary in the same direction, which is to the benefit of the time constancy of the time control circuit 17.

The time control circuit 19 is correspondingly assembled. Elements of like effect are designated with the same reference numerals and for better distinguishability merely provided with the additional letter a. For the explanation of the assembly and manner of operation therefore reference is made to the description of the time control circuit 17. The inverting input "−" of the comparator **77*a* is connected to the same junction point 79, supplying the reference voltage, of the resistors 81 and 83**. If desired a separate reference voltage source can be provided.

In the embodiment according to FIG. 2 again the press-button switch 27 is connected on the one side to earth and on the other side through the collector-emitter junction of the transistor 33 with the lead 73 forming the trigger input 21 and through the collector-emitter junction of the transistor 35 with the lead **73*a* forming the trigger input 23. The base of the transistor 33 is connected through a base-current-limiting resistor 93 with the output of the comparator 37. The inverting input "−" of the comparator 37 is connected to the junction point 79 of the resistors 81, 83 serving as reference voltage source. A feedback resistor 95, connecting the output of the comparator 37 with its non-inverting input "+", in combination with the resistor 39, determines the gain of the comparator 37 and ensures a stable operation. As already explained with reference to FIG. 1, the base of the transistor 35 is connected through a voltage-divider circuit consisting of the resistors 45 and 47 and the control switch or ignition switch 43, to the working voltage terminal 11, in such a way that the transistor 35 is conductive when the ignition switch 43 is closed and blocked when the ignition switch 43 is opened. The switch contacts 41 which respond to the drive position of the catch drives are again connected in parallel with one another between the non-inverting input "+" of the comparator 37** and earth.

With the ignition switch 43 opened and thus the ignition switched off, the central locking installation can only be locked, but not unlocked, by actuation of the press-button switch 27. The following course of operation results:

By actuation of the press-button switch 27 the emitters of the transistors 33 and 35 are earthed. The transistor 35 cannot become conductive, since its base is likewise earthed, through the resistor 47. The inverting input "−" of the comparator 37 is kept by the resistors 81, 83 at a voltage of about $\frac{1}{3}$ of the working voltage, independently of the switch condition of the ignition switch 43. The non-inverting input "+" of the comparator 37 lies at working voltage potential, through the resistors 39 and 95. The output potential of the comparator 37 corresponds approximately to the working voltage potential and switches the transistor 33 to become conductive. Accordingly the lead 73 lies substantially at earth potential and the time control circuit 17 of the relay 7 switching the motors 1 on in the locking direction is triggered. After the execution of this locking command the switch contacts 41 are closed. Through the switch contacts 41 the non-inverting input "+" of the comparator 37 now lies at earth potential and its output level opens the transistor 33. Further actuation of the press-button switch 27 thus remains without effect.

When the ignition switch 43 is closed the central locking installation can be unlocked again by means of the press-button switch 27. With the ignition switch 43 closed, the base of the transistor 35 lies at positive potential through the resistor 45. On actuation of the press-button switch 27 the emitter thereof is earthed. The transistor 35 becomes conductive and the time control circuit 19 of the relay 9 which switches on the motors 1 in the unlocking direction is triggered. After the triggering of the time control circuit 19 the relay 7 must remain de-energised during the predetermined duration of energisation of the relay 9. The transistor 33 which controls the triggering of the time control circuit 17 is held opened, in the locking position of the catch drives, by the then closed switch contacts 41. However the switch contacts 41 open in the course of the unlocking movement or the motors 1, whereby, if the press-button switch 27 is then still actuated, the time control circuit 17 would also be triggered. In order to prevent this the press-button switch 27 is connected through a resistor 97 with the non-inverting input "+" of the comparator 37. The resistor 97 holds the non-inverting input "+" of the comparator 37, with press-button switch 27 actuated, in combination with the resistors 39 and 95, at a potential less than the potential at the junction point 79, that is at a potential less than $\frac{1}{3}$ of the working potential. If with the press-button switch 27 an unlocking operation was instigated, then for the duration of the actuation of the press-button switch 27 the trigger path of the time control circuit 17 controlling the locking operation remains blocked. The comparator 37 switches over as soon as the press-button switch 27 is opened. A subsequent actuation of the press-button switch 27 switches on the central locking installation in the locking direction. In order to prevent undesired switching over if the press-button switch 27 rebounds, the non-inverting input "+" of the comparator 37 is connected with the emitter of the transistor 15 through a diode 99 polarised in the forward direction. As explained above, the emitter of the transistor 15 lies at earth potential during the time duration predetermined by the time control circuit 19. Thus during the energisation time of the relay 9 the diode 99 opens the transistor 33 and prevents the triggering of the time control circuit 17.

After the elapse of the time duration predetermined by the time control circuit 19 the central locking installation can be locked by renewed actuation of the press-button switch 27. On renewed actuation of the press-button switch 27 the transistors 33 and 35 become conductive at the same time. Thus the two time control circuits 17 and 19 are triggered simultaneously. In order to prevent the relay 9 from being energised as well as the relay 7 which switches on the motors 1 in the locking direction, a Zener diode 101 polarised in the blocking direction is connected between the base of the transistor 15 and its base series resistor 75*a*. Furthermore the junction point of the resistor 75*a* and of the Zener diode 101 is connected with the collector of the transistor 13 through a diode 103 polarised in the forward direction for the output current of the comparator 77*a*. When the transistor 13 is conductive its collector lies approximately at earth potential, so that the diode 103 short-circuits the junction point of the resistor 75*a* and the Zener diode 101 to earth. Despite the fact that the time control circuit 19 is triggered the transistor 15 remains opened and the relay 9 is not energised.

In order that it may be indicated whether the central locking installation was locked, with the ignition switched on, an indicator lamp 105 is provided which is connected in series with the collector-emitter junction of a transistor 107 between earth and the ignition switch 43. The transistor 107, in contrast to the other transistors which are formed as npn transistors, is a pnp transistor. The transistor 107 is connected to positive potential on the emitter side and is connected on the base side through a resistor 109 with the switch contacts 41 and the non-inverting input "+" of the comparator 37. When the central locking installation is locked, the base of the transistor 107 lies at about earth potential, so that the transistor 107 is conductive and the indicator lamp 105 lights up. In the unlocked condition or when the ignition switch 43 is opened the indicator lamp 105 is switched off.

While specific embodiments of the invention have been shown and described in detail to illustrate the application of the inventive principles, it will be understood that the invention may be embodied otherwise without departing from such principles.

What is claimed is:

1. In a central locking system for motor vehicles in which the ignition and/or a starter can be switched on and off by means of a control switch operable by means of a key, said system having a plurality of catch drives reversibly driving between a locking position and an unlocking position, a first time control means which on triggering supplies first drive signals for a predetermined time duration to the catch drives which drive the catch drives in the direction towards the locking position, a second time control means which on triggering supplies second drive signals for a predetermined time duration to the catch drives which drive the catch drives in the direction towards the unlocking position, and at least one triggering control switch operable from outside the motor vehicle by means of a key, which switch in a first switch position triggers the first time control means and in a second switch position triggers the second time control means, the provision of (a) at least one common press-button control switch for operation within the motor vehicle;

(b) trigger paths for respective connection of the first and second time control means to said common press-button switch, said trigger path connecting the press-button control switch with the first time control means being triggerable independently of the switch position of the control switch and comprising:

a first gate circuit responding to the drive position of the catch drives which blocks the trigger path when the catch drives are in the locking position, and enables the first time control means to be triggered by the press-button control switch when the catch drives are in the unlocking position, said trigger path connecting the press-button control switch with the second time control means comprising:

a second gate circuit controllable through the control switch which blocks the trigger path when the control switch is switched off and enables the second time control means to be triggered by the press-button control switch when the control switch is switched off; and (c) a blocking circuit responding to the drive signals of the first time control means for blocking the drive signals of the second time control means during the occurrence of the drive signals of the first time control means.

2. A central locking system according to claim 1, wherein a switch contact responsive to the drive position of the catch drive is allocated to each catch drive, said first gate circuit comprising a transistor switch connected into the trigger path and a control signal generator controlling the transistor switch and responding to the switch contact.

3. A central locking system according to claim 2, wherein the control signal generator comprises a control voltage source responding to the switch contacts, which generates a first control voltage when at least one of the switch contacts detects the locking position of the catch drive allocated to it and a second control voltage when all switch contacts detect the unlocking position of the associated catch drives, and wherein the control signal generator further comprises a reference voltage source, the reference voltage of which lies between the first and the second control voltages, and a comparator which compares the reference voltage with the control voltage and accordingly controls the transistor switch.

4. A central locking system according to claim 3, wherein the control voltage source is coupled to the press-button control switch and for the duration of the actuation of the press-button switch supplies a third control voltage placed together with the first control voltage on the same side of the reference voltage to the comparator for comparison with the reference voltage.

5. A central locking system according to claim 3 or 4, wherein the reference voltage amounts to about $\frac{1}{3}$ of the operating voltage, the first control voltage has about earth potential, the second control voltage corresponds approximately to the operating voltage.

6. A central locking system according to claim 4, wherein the first time control means is triggerable by application of earth potential to a trigger input, wherein the transistor switch of the first gate circuit comprises a transistor the collector-emitter junction of which is connected in series with the press-button control switch between earth and the trigger input of the first time control means and the base of which is connected with the output of the comparator, the control voltage source comprises a resistor connected in shunt to the control switch between a battery of the motor vehicle and one of the inputs of the comparator and a feedback resistor connecting this input with the output, and wherein the switch contacts are connected between this input of the comparator and earth and the press-button control switch is connected in series with a further resistor between earth and this input of the comparator.

7. A central locking system according to claim 6, wherein the transistor of the first gate circuit is formed as an npn transistor and the control voltage source is connected to the non-inverting input of the comparator, and the reference voltage source is connected to the inverting input.

8. A central locking system according to claim 1, wherein to each catch drive there is allocated a switch contact which detects the drive position of the catch drive, and wherein the switch contacts are connected with one another in the form of an OR contact network which blocks the first gate circuit when at least one of the switch contacts detects the locking position of the catch drive associated with it.

9. A central locking system according to claim 8, wherein the switch contacts are connected in parallel with one another and close in the locking position of the associated catch drive.

10. A central locking system according to claim 1, wherein the second time control means is triggerable by application of earth potential to a trigger input, and the second gate circuit comprises a transistor switch having a transistor the collector-emitter junction of which is connected in series with the press-button control switch between earth and the trigger input of the second time control means and the base of which is connected with the main control switch.

11. A central locking system according to claim 1, wherein said two time control means each comprise an output stage formed as transistor switch for controlling the drive signals of the catch drives, and the output of the output stage of the first time control means is coupled through a coupling member with a control input of the output stage of the second time control means and opens the transistor switch of the output stage of the second control means independently of the trigger condition of the second time control means if the transistor switch of the first time control means is closed.

12. A central locking system according to claim 1, wherein to each catch drive there is allocated a switch contact detecting the drive position of the catch drive, and to the control switch there is connected an indicator lamp in series with a transistor switch, the control input of which is connected with the switch contacts in such a way that the transistor switch switches on the lamp when at least one of the switch contacts detects the locking position of the associated catch drive.

* * * * *